US005185889A

United States Patent [19]

Kamata

[11] Patent Number: 5,185,889

[45] Date of Patent: Feb. 16, 1993

[54] SHIELD SYSTEM FOR HELMET

[75] Inventor: Eitaro Kamata, Tokyo, Japan

[73] Assignee: Shoei Kako Kabushiki Kaisha, Tokyo, Japan

[21] Appl. No.: 727,683

[22] Filed: Jul. 10, 1991

[30] Foreign Application Priority Data

Feb. 19, 1991 [JP] Japan ..... 3-7077[U]

[51] Int. Cl.[5] ..... A42B 1/08

[52] U.S. Cl. ..... 2/424

[58] Field of Search ..... 2/410, 411, 422, 424, 2/425, 10

[56] References Cited

U.S. PATENT DOCUMENTS 4,047,249 9/1977 Booth ..... 2/424
4,866,792 9/1989 Arai ..... 2/424
5,005,221 4/1991 Chen ..... 2/424

FOREIGN PATENT DOCUMENTS 3041082 5/1981 Fed. Rep. of Germany ..... 2/424
3231744 7/1983 Fed. Rep. of Germany ..... 2/410
2172791 10/1986 United Kingdom ..... 2/10

*Primary Examiner*—Andrew M. Falik
*Assistant Examiner*—Michael A. Neas
*Attorney, Agent, or Firm*—Armstrong, Westerman, Hattori, McLeland & Naughton

[57] ABSTRACT

In a helmet shield system, a shield plate is comprised of a shield body covering a window opening in a front surface of a cap body, and an end plate pivotally mounted on the cap body, the shield body and the end plate being coupled to each other by eyelets. A click stop mechanism is provided between the end plate and a base plate fixed to the cap body, and a cover is secured to cover the end plate. In this case, the shield body is formed from any of a polycarbonate, an acrylic resin, and a polyvinyl chloride, and the end plate is formed from any of a polyacetal, nylon and ABS. This provides a good view through the shield plate with a high transparence and an increased durability of the click stop mechanism which retains the shield plate at a desired opening degree.

6 Claims, 6 Drawing Sheets

SHIELD SYSTEM FOR HELMET

BACKGROUND OF THE INVENTION

1. FIELD OF THE INVENTION

The field of the present invention is helmets for use by an occupant primarily on a motorcycle or an automobile, and particularly, shield systems for helmets of a type including a shield plate pivotally mounted on a cap body for opening and closing a window opening provided in a front wall of the cap body, and a click stop mechanism provided between the shield plate and the cap body for retaining the shield plate at desired opening degrees in a stepwise fashion.

2. DESCRIPTION OF THE PRIOR ART

In such a conventional shield system, the shield plate is constructed from a single transparent member, and the click stop mechanism is provided between the transparent member and the cap body, for example, as disclosed in U.S. Pat. No. 4,907,299.

For the shield plate, an excellent transparence is required to ensure a good visibility for a user wearing the helmet. In addition wear and shock resistances are required to provide an increased durability of the click stop mechanism. But there is a limit to satisfy all these physical properties by use of a single material.

SUMMARY OF THE INVENTION

Accordingly, it is an object of the present invention to provide a shield system for a helmet, which is capable of sufficiently satisfying both of a good visibility and an increased durability of the click stop mechanism.

To achieve the above object, according to the present invention, there is provided a shield system for a helmet, comprising a shield plate pivotally mounted on a cap body for opening and closing a window opening provided in a front wall of the cap body; and a click stop mechanism provided between the shield plate and the cap body for retaining the shield plate at desired opening degrees in a stepwise fashion, wherein the shield plate is comprised of a shield body formed of a synthetic resin material having a high transparence and capable of covering the window opening, and an end plate made of a synthetic resin material having a wear resistance higher than that of the shield body, the end plate being coupled to an end of the shield body and being pivotally supported on the cap body, the click stop mechanism being provided between the end plate and the cap body, and a cover being secured to the cap body for covering the end plate.

With the above feature of the present invention, a good visibility can be ensured by the transparent shield body, and the durability of the click stop mechanism can be increased by the wear resistant end plate. Moreover, not only the end plate itself but also a boundary between the end plate and shield body can be covered by the cover, leading to an extremely good appearance.

The above and other objects, features and advantages of the invention will become apparent from the following description of the preferred embodiments, taken in conjunction with the accompanying drawings.

BRIEF DESCRIPTION OF THE DRAWINGS

FIG. 2 is an enlarged cross-sectional view of an essential portion shown in FIG. 1;

FIG. 3 is a sectional view taken along a line 3—3 in FIG. 2;

FIG. 4 is an exploded perspective view of the shield system;

FIG. 5 is a sectional view taken along a line 5—5 in FIG. 4; and

DESCRIPTION OF THE PREFERRED EMBODIMENTS

The present invention will now be described by way of embodiments in connection with the accompanying drawings.

Figure 1:
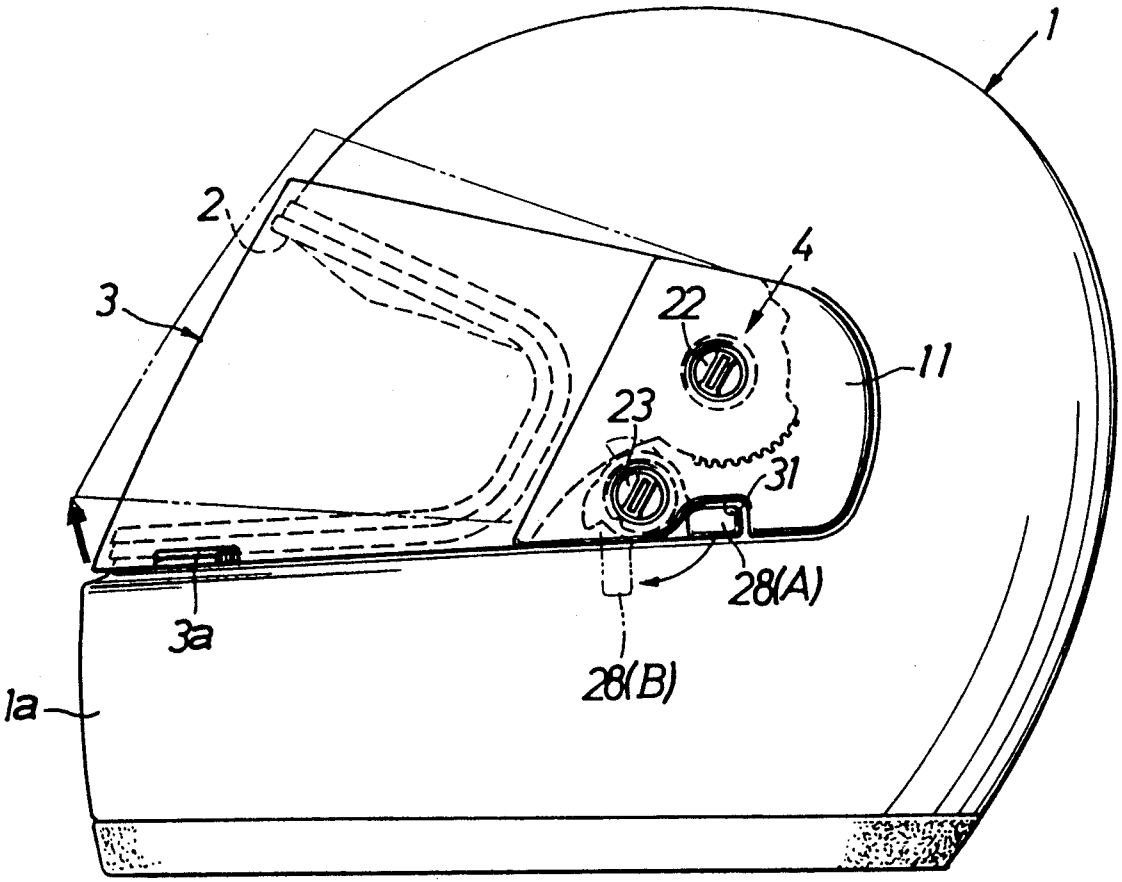
FIGS. 1 to 5 illustrate a first embodiment of the present invention, wherein, FIG. 1. is a side view of a helmet provided with a shield system of the first embodiment of the present invention.
Figure 2:
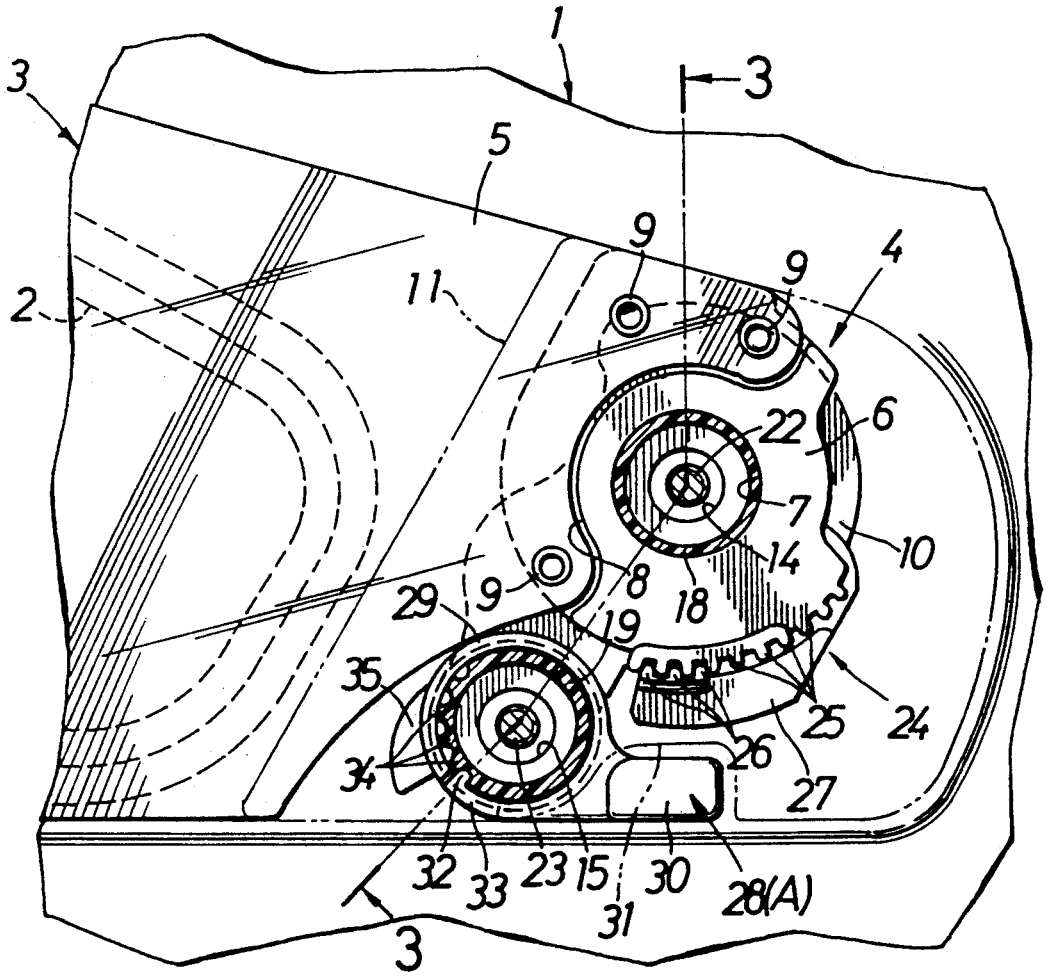

FIGS. 1 to 5 illustrate a first embodiment of the present invention. Referring first to FIG. 1, a cap body 1 of a helmet for use in riding a vehicle is constructed into a full-face type having a chin covering portion 1*a* directly below a window opening 2 in a front wall of the cap body 1. A shield plate 3 is attached at its left and right ends to the cap body 1 through a pivotally mounting device 4 for opening and closing the window opening 2. The shield plate 3 is curved forwardly to corresponding to a shape of a front surface of the cap body 1.

Figure 3:
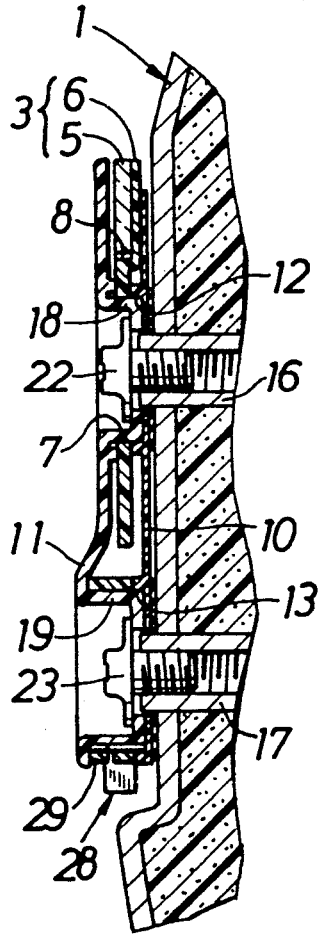
Figure 4:
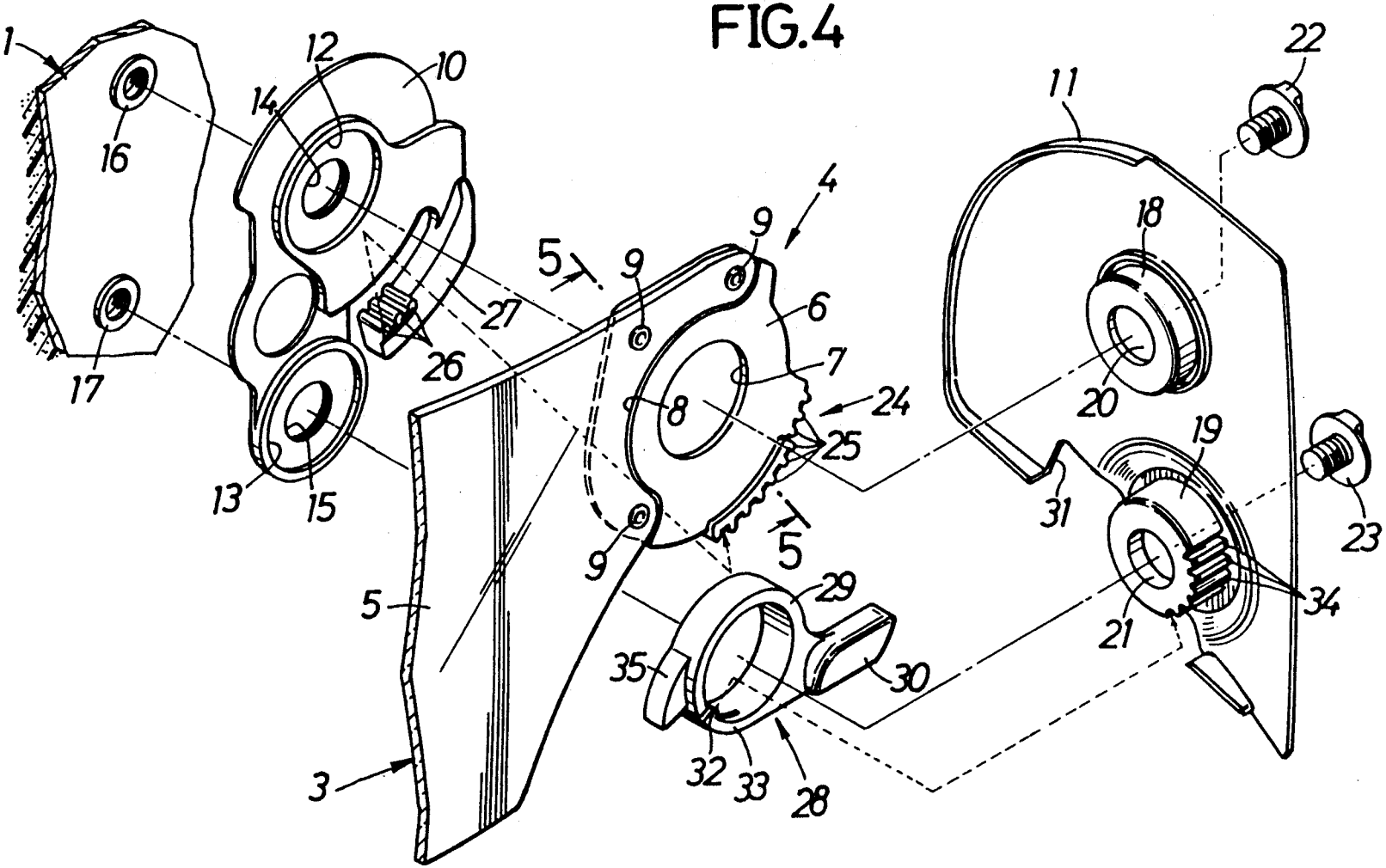
Figure 5:
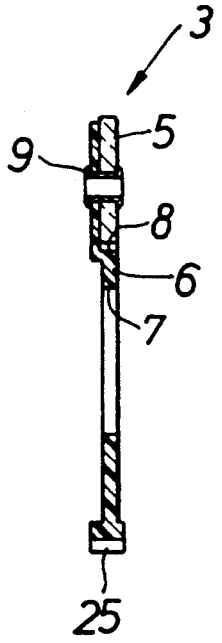

The pivotally mounting device 4 for the shield plate 3 will be described in connection with FIGS. 3 to 5. The left and right structures of pivotally mounting device are indentical to each other and hence, the only left structure will be described below.

The shield plate 3 includes a transparent shield body 5 capable of completely covering the window opening 2, and end plates 6 each coupled to corresponding one of left and right ends of the shield body 5. Each of the end plate 6 has a support hole 7 at a central portion thereof. An arcuate step 8 concentric with the support hole 7 formed on an outer surface of each and plate 6. The shield plate 3 is superposed on the end plate 6, so that the end of the shield plate 3 mates with the arcuate step 8. And the shield body 5 and the end plate 6 are coupled to each other by three eyelets 9 arranged along the arcuate step 8. In this manner, the outer surfaces of the shield body 5 and the end plate 6 are made into continuous smooth surfaces (see FIG. 5).

In this case, the shield body 5 is made of any of synthetic resins having a high transparence and a low refractive index, such as polycarbonate, acrylic, and polyvinyl chloride by any appropriate means, such as by molding and the like. The end plate 6 is made of any of synthetic resins having high wear and shock resistances, such as polyacetal, nylon and ABS by any appropriate means, such as by molding and the like.

A base plate 10 and a cover 11 for covering the end plate 6 which is superposed on the base plate 10 are secured in a manner which will be described hereinafter. It should be noted that the base plate 10 is formed of any of synthetic resins having wear and shock resistances and a resilience, such as polyacetal, nylon and ABS.

A pair of circular recesses 12 and 13 are provided in an outer surface of the base plate 10 at vertically spaced apart locations. Through holes 14 and 15 are made in central portions of the recesses 12 and 13, respectively.

Nuts 16 and 17 are embedded in the cap body 1 in correspondence to the through holes 14 and 15, respectively. The cover 11 is provided with a first bottomed cylindrical pivot 18 passing through the support hole 7 in the end plate 6 and fitted in the upper recess 12. The cover 11 is also provided with a second bottomed cylindrical pivot 19 fitted in the lower recess 13. These pivots 18 and 19 are formed with their tip ends projecting toward the base plate 10. Through holes 20 and 21 are provided in the tip end walls of the pivots 18 and 19 coaxially with the through holes 14 and 15, respectively. In a condition in which the first pivot 18 has passed through the support hole 7 and has been fitted into the upper recess 12, a machine screw 22 is inserted sequentially through the through holes 20 and 14 and then is screwed into the nut 16. In addition, with the second pivot 19 fitted into the lower recess 13, a machine screw 23 is inserted sequentially through the through holes 21 and 15, and screwed into the nut 17. In this manner, the base plate 10 and the cover 11 are fixed to the cap body 1, so that the shield plate 3 can be pivotally moved or turned about the first pivot 18 between the base plate 10 and the cover 11.

A large number of movable click teeth 25 are formed in a rear and outer edge of the end plate 6 in a shape of a sector concentric with the first pivot 18. A resilient arm 27 is integrally formed with the base plate 10 and has several stationary click teeth 26 meshed with the movable click teeth 25. The resilient arm 27 has a resilience in a radial direction of the first pivot 18, so that the stationary click teeth 26 engage with the movable teeth 25 by a resilient force thereof. The movable click teeth 25, the stationary click teeth 26 and the resilient arm 27 constitute a click stop mechanism 24 for stepwisely retaining the shield plate 3 in desired opening degrees in a stepwise fashion.

The above is the description of the construction of the pivotally mounting structure 4.

An operating lever 28 is pivotally carried on the second pivot 19 which is positioned on the right side of the cap body 1. The operating lever 28 includes a boss portion 29 fitted over the second pivot 19, and a lever portion 30 extending in one tangential direction of the boss portion 29. A notch 31 is provided at a lower portion of the cover 11 for permitting the lever portion 30 to be exposed from the cover 11.

The operating lever 28 is integrally formed from a synthetic resin. A resilient arm 33 is integrally formed with the boss portion 29 and has a single movable click tooth 32 at its tip end. On the other hand, a large number of stationary click teeth 34 are formed on an outer peripheral surface of the second pivot 19 and adapted to be engaged by the movable click tooth 32 by a resilient force of the resilient arm 33. Thus, the operating lever 28 is pivotally movable about the second pivot 19 between a retreat limit 28(A) in which the lever portion 30 abuts against a rear end edge of the notch 31 of the cover 11 and an advance limit 28(B) in which the lever portion 30 abuts against a front end of the notch 31 (see FIG. 1). The pivotally moved position of the operating member 28 can be stepwise maintained by engagement of both the click teeth 32 and 34.

Further, the boss portion 29 is integrally provided with a cam portion 35 which is abutable against a lower edge of the shield plate 3. The cam portion 35 is formed so that as the operating lever 28 is pivotally moved or turned from the retreat limit 28(A) to the advance limit 28(B), the lower edge of the shield plate 3 is gradually urged up.

The operation of this embodiment will be described below.

If the user holds a knob 3*a* and lowers the shield plate 3 to the retreat limit after setting the operating lever 28 at the retreat limit 28(A), the shield plate 3 is brought into a fully closed state in which it is close contact with a peripheral edge of the window opening 2.

If the operating lever 28 is now turned toward the advance limit 28(B), the cam portion 35 thereof gradually urges the lower edge of the shield plate 3 upwardly. This enables the shield plate 3 to be opened in a desired small opening degree in such an extent that the movable click teeth 25 in the click stop mechanism 24 moves one pitch relative to the stationary click teeth 26.

If the knob 3*a* is then held to turn the shield plate 3 upwardly, the movable and stationary click teeth 25 and 26 have their engaged positions changed step by step while deflecting the resilient arm 27, so that the shield plate 3 can be retained at a fully opened position and a position of a desired opening degree less than the full opening.

In such shield system, the shield plate 3, as described above, is comprised of the shield body 5 and the end plate 6 being coupled to each other. The shield body 5 is formed of a synthetic resin as described above and has a high transparence and a low refractive index. The end plate 6 is formed of a synthetic resin as described above and has high wear and shock resistances, and the movable click teeth 25 of the click stop mechanism 24 are formed on the end plate 6. Therefore, it is possible to provide a good visibility of the shield plate 3 and an increased durability of the click stop mechanism 24.

In addition, the base plate 10 includes the resilient arm 27 having the stationary click teeth 26 of the click stop mechanism 24 is formed of a synthetic resin as described above and having higher wear and shock resistances and resilience and therefore, it is possible to provide a further increased durability of the click stop mechanism 24 while maintaining a higher retaining force.

Moreover, since the end plate 6 is covered by the cover 11, a boundary between the shield body 5 and the end plate 6 is also not exposed outside the cover 11 and hence, it is possible to provide an improved appearance.

Figure 6:
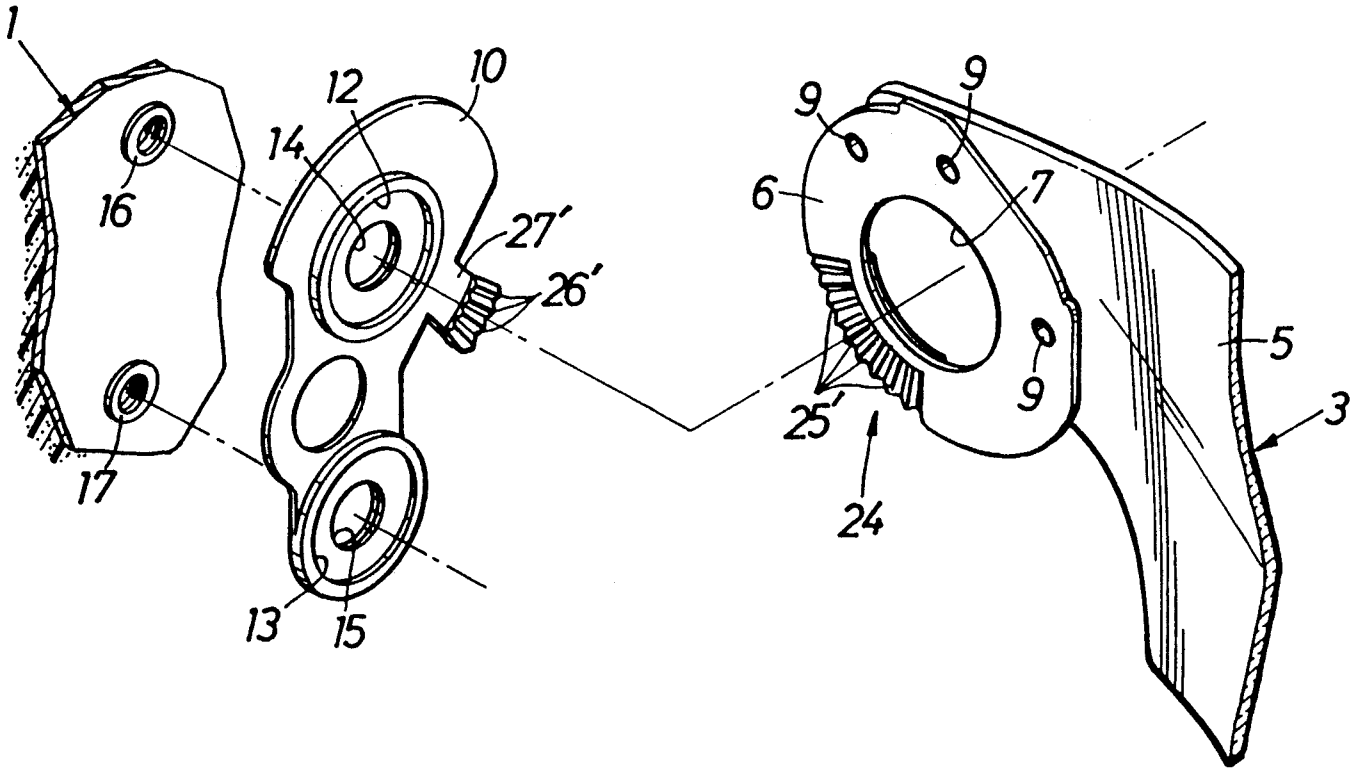
FIG. 6 is an exploded perspective view of an essential portion of a shield system of a second embodiment of the present invention.

FIG. 6. Illustrates a second embodiment of the present invention. The second embodiment has a construction substantially similar to that of the previous embodiment, except that a click stop mechanism 24 includes a large number of movable click teeth 25' formed on an inner surface of an end plate 6 and arranged radially about the first pivot 18, and a resilient piece 27' which is integrally formed with a base plate 10 and which includes a stationary click teeth 26' on an outer surface. The movable click teeth 25' have resilience in the axial direction of the first pivot 18, so that the stationary click teeth 26' are resiliently brought into engagement with the movable click teeth 25'.

What is claimed is:

1. A shield system for a helmet, comprising a shield plate pivotally mounted on a cap body for opening and closing a window opening in a front wall of the cap body; and a click stop mechanism between said shield plate and said cap body for retaining said shield plate at desired opening degrees in a stepwise fashion, wherein said shield plate is comprised of a shield body formed of a synthetic resin material having a high transparency and capable of covering said window opening, and an end plate made of a synthetic resin material having a wear resistance higher than that of the shield body, said end plate being coupled to an end of said shield body and being pivotally supported on said cap body, said click stop mechanism being between said end plate and said cap body, and a cover secured to said cap body for covering said end plate.

2. A shield system for a helmet according to claim 1, wherein said click stop mechanism is comprised of a plurality of movable click teeth formed on an outer periphery of said end plate and having a shape of a sector concentric with a pivotal axis of the shield plate, and a resilient arm which is integrally connected to a base plate secured to said cap body inside said end plate and which includes stationary click teeth provided on a tip end of the resilient arm and is resilient in a radial direction of the pivotal axis of the shield plate, said stationary click teeth being resiliently brought into engagement with said movable click teeth.

3. A shield system for a helmet according to claim 1, wherein said click stop mechanism is comprised of a plurality of movable click teeth formed on an inner surface of said end plate and arranged radially about a pivotal axis of said shield plate, and a resilient piece which is integrally connected to a base plate secured to said cap body inside said end plate and which includes stationary click teeth provided on an outer surface of the resilient piece and is resilient in a direction of the pivotal axis of the shield plate, the stationary click teeth being resiliently brought into engagement with the movable click teeth.

4. A shield system for a helmet according to claim 1, 2 or 3, wherein said shield body is made from any of a polycarbonate, an acrylic resin, and a polyvinyl chloride, and said end plate is made from any of a polyacetal, nylon and ABS.

5. A shield system for a helmet according to claim 2 or 3, wherein said base plate is made from any of a polyacetal, nylon and ABS.

6. A shield system for a helmet, comprising:

a shield plate pivotally mounted on a cap body for opening and closing a window opening provided in a front wall of said cap body; and a click stop mechanism between said shield plate and said cap body for retaining said shield plate at desired pivot angles in a stepwise fashion, wherein said shield plate is comprised of a shield body and an end plate;

said shield body is formed of a synthetic resin material having a high transparence and capable of covering said window opening;

said end plate being formed of a synthetic resin material having a wear resistance higher than that of the shield body and pivotally supported on the cap body;

said end plate being provided with a substantially arcuate step corresponding to a shape of an end of the shield body, for receiving the end of a shield body when said end plate is coupled to the end of the shield body;

said click stop mechanism being provided between the end plate and the cap body.

* * * * *